United States Patent [19]

Khan

[11] Patent Number: 4,554,794

[45] Date of Patent: Nov. 26, 1985

[54] CONDENSATE RECEPTACLE SUPPORT FOR DEHUMIDIFIER

[75] Inventor: Aman U. Khan, Lincoln Township, Berrien County, Mich.

[73] Assignee: Whirlpool Corporation, Benton Harbor, Mich.

[21] Appl. No.: 622,867

[22] Filed: Jun. 20, 1984

[51] Int. Cl.[4] ..... F25D 21/00

[52] U.S. Cl. ..... 62/150; 62/137; 200/61.07

[58] Field of Search ..... 62/272, 150, 137; 200/62.7, 61.07

[56] References Cited

U.S. PATENT DOCUMENTS

| | | | |
|---|---|---|---|
| 2,759,335 | 8/1956 | Weschler, Jr. . | |
| 2,956,417 | 10/1960 | Lyman . | |
| 2,994,205 | 8/1961 | Brubaker et al. | 62/137 X |
| 3,496,731 | 2/1970 | Sholtes . | |
| 3,500,654 | 3/1970 | Sholtes . | |
| 4,254,311 | 3/1981 | Sisk, Jr. . | |
| 4,321,800 | 3/1982 | Gifford, Jr. . | |
| 4,413,515 | 11/1983 | Quinn . | |

*Primary Examiner*—William E. Wayner

*Attorney, Agent, or Firm*—Wood, Dalton, Phillips, Mason & Rowe

[57] ABSTRACT

A spring support clip is provided for mounting a condensate collection receptacle adjustably pivotally relative to an upright wall on a dehumidifier. The support clip has a free end cooperating with the receptacle and is configured to be readily deflectable vertically but more resistant to deformation in other than the vertical direction. The spring support clip is arranged to simultaneously support and guidingly control pivoting movement of the receptacle occasioned by an increase in the condensate accumulation. A shut-off switch is operated depending upon the orientation of the receptacle as dictated by the condensate level.

16 Claims, 7 Drawing Figures

FIG. 1
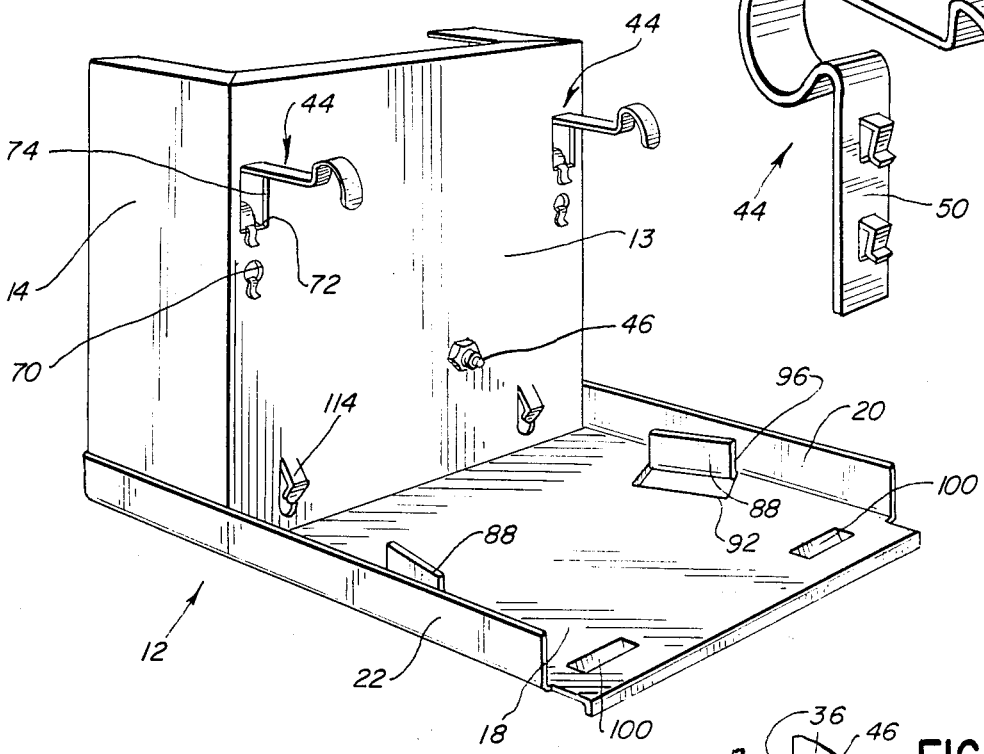
FIG. 2
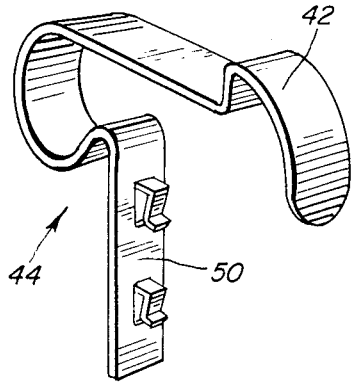
FIG. 3
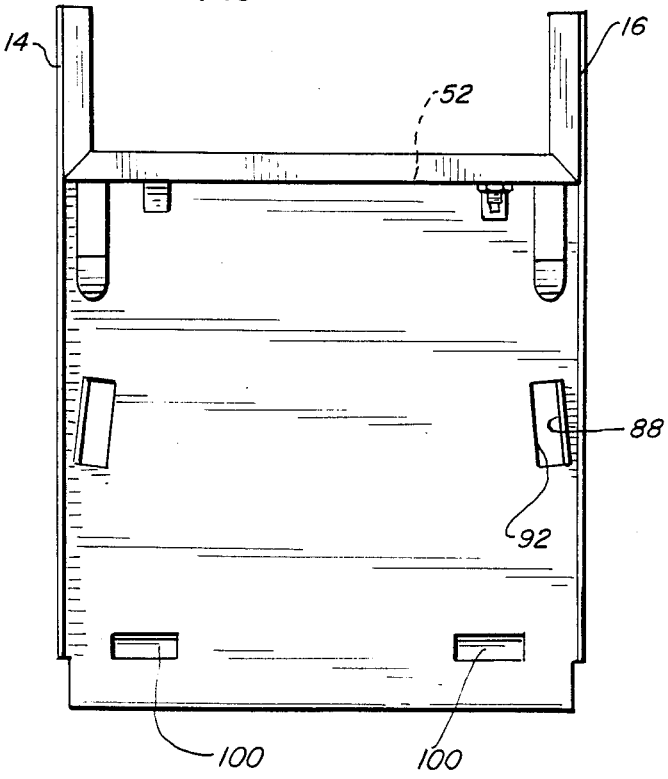
FIG. 5
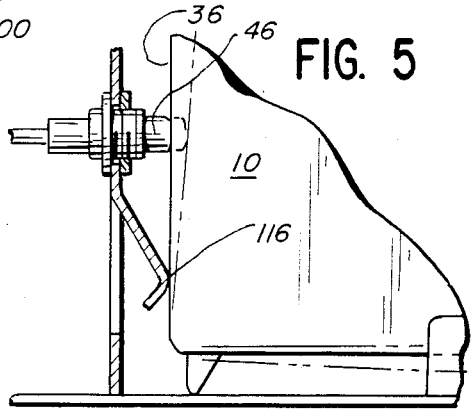
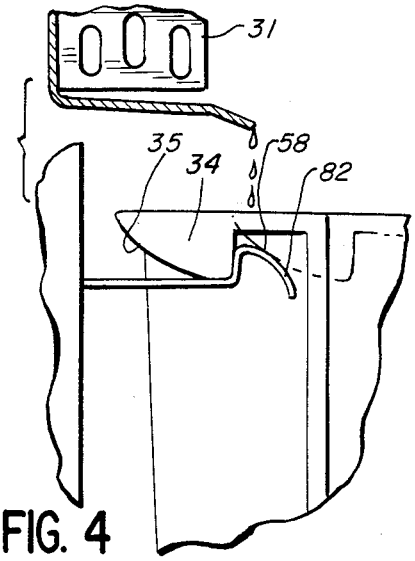
FIG. 4

CONDENSATE RECEPTACLE SUPPORT FOR DEHUMIDIFIER

BACKGROUND OF THE INVENTION

1. Field of the Invention

This invention relates to condensate collecting receptacles for dehumidifiers and the like and, more particularly, to an adjustable mounting for the receptacle which interrupts operation of the dehumidifier when the condensate has accumulated to a predetermined level in the receptacle.

2. Background Art

Dehumidifiers, or other apparatus that gradually develop a condensate during operation, frequently are provided with a removable receptacle for collecting liquid discharge. These receptacles are typically mounted so that they reorient in response to a buildup of liquid to cause actuation of a switch, which interrupts the operation of the dehumidifier until the receptacle is removed or emptied.

A structure that is exemplary of the state of the prior art is shown in U.S. Pat. No. 4,254,311, to Sisk Jr. In Sisk Jr., spaced mounting brackets are carried rigidly in cantilever fashion by a vertical wall of a dehumidifier and bear beneath a peripheral rim associated with the upper portion of the receptacle.

A bowed leaf spring overlies a depressible button for a shut-off switch on the dehumidifier wall. The spring is attached to the wall at only one end and preloaded so that the free end of the spring is pressed frictionally against the vertical wall of the dehumidifier. The weight of the condensate accumulating receptacle as it fills compresses the spring toward the dehumidifier and causes the free end of the spring to slide along the wall of the dehumidifier, flattening the bow in the spring and effecting contact with the switch button. At a predetermined weight, which can be related to a desired liquid level in the receptacle, the operation of the dehumidifier is interrupted.

The Sisk, Jr. structure has several drawbacks in terms of its receptacle mounting and switch actuation. As far as the mounting is concerned, the user works essentially blindly in situating the brackets beneath the receptacle rim. This is because the view is obstructed by the overhanging portion of the dehumidifier which delivers the condensate to the receptacle. The user is unable to ascertain with certainty whether or not the receptacle is properly positioned.

In the event that the receptacle is improperly seated, the wall of the receptacle attacks the leaf spring at an angle that varies the force required to collapse it against the control switch. The receptacle might also dislodge from the brackets as the weight of accumulated liquid increases. The potential damage and inconvenience from the spillage is apparent.

The principal drawback with the switch actuation mechanism is that the water level at which shut-off occurs may vary considerably over time for a given spring setting. The free end of the spring bearing on the dehumidifier wall tends, after repeated fillings, to score the wall. As a result, the coefficient of friction varies and thereby changes the force required to bring the spring into engagement with the switch. The result is that the liquid level at which shut-off occurs may become unpredictable.

Another drawback with the Sisk, Jr. switching structure is that the dehumidifier will operate without the receptacle in place. This is typical of a structure that requires pivoting of the receptacle towards a depressible switch button on the dehumidifier to effect shut-off. The potential for inadvertently failing to install the receptacle and causing a discharge of condensate onto the floor or other supporting surface arises.

SUMMARY OF THE INVENTION

The present invention is specifically directed to overcoming the above enumerated problems known in the prior art in a novel and simple manner.

In one aspect of the invention, a spring support clip is provided for mounting a collection receptacle adjustably relative to an upright wall on a structure such as a dehumidifier that gradually develops a condensate. The support clip has a free end cooperating with the receptacle and is configured to be readily deflectable vertically but more resistant to horizontal shifting of the receptacle.

The spring support clip is particularly adaptable to guidingly control pivoting movement of the receptacle in cooperation with a bearing platform that engages a bottom pivot surface on the receptacle. The clip support is attached to the upper portion of the receptacle. Upon filling of the receptacle, the developed weight urges the upper portion of the receptacle away from the dehumidifier wall against the force of the clip support and in pivoting fashion about the bottom pivot surface resting on the platform.

It is contemplated that a push button type operating switch be provided on the wall of the dehumidifier adjacent to which the receptacle is mounted. The button is depressed and the dehumidifier activated upon mounting the receptacle. With the empty receptacle properly in place, the receptacle is tilted so that the side remote from the dehumidifier is elevated above the platform. As the condensate accumulates, its weight urges the raised side downward towards the platform, rotating the receptacle about the bottom pivot surface and drawing against the spring clips. Upon pivoting the receptacle a predetermined amount, the activating switch button is fully released, thereby interrupting the operation of the dehumidifier.

The described switch arrangement is fail-safe. The dehumidifier will not operate until such time as the receptacle is mounted to depress the activating button.

Predictability in the shut-off level is assured by providing a spring force with the elimination of spring damping. In a preferred form, the clip is made from a length of strip having a mounting portion with mounting tabs struck therefrom for engagement with the wall of the dehumidifier. From the mounting portion the strip is formed through an arc with a first radius and reverse curved to define a second arcuate portion having a radius of curvature larger than the first radius. The strip terminates in a support arm having a free end suspended in cantilever fashion from the dehumidifier.

The support arm is extended through an aperture in the dehumidifier wall and suspends the receptacle. The described spring clip arrangement allows substantially unrestrained vertical shifting of the support arm within the confines of the aperture while providing substantial, controlled resistance to horizontal movement and thus outward tilting motion of the receptacle as it fills.

The receptacle is provided with an upper rim and a guide ramp which cooperate with a cammed portion at the free end of the support arm to deflect the arm and direct the cam portion into a female socket defined on the receptacle. The forces in the support arm resulting from preloading, in addition to those created by the additional deflection, propel the cam surface positively into the socket so that the user can sense that the same is properly engaged.

To assure that the mounting is foolproof, a pair of guide plates are provided at each side of the receptacle and converge in the direction of movement of the receptacle towards the dehumidifier wall. Further, the vertical extent of the aperture is such that the support arm is preloaded and consistently located against the upper border of the aperture.

To effect mounting, the bottom pivot surface at the leading edge of the receptacle is placed in contact with the platform and the entire receptacle slid towards the wall of the dehumidifier to present the cam surface on the spring clip support and the ramp surface on the receptacle with each other. The guide plates assure proper alignment of the receptacle with the support clips. Because the arm of the spring clip support is consistently located, the cam and ramp surfaces on the receptacle and spring clip supports meet in a consistent manner.

It is another aspect of the invention to provide an adjusting structure for the level control without compromising the aforementioned consistency of operation. According to the invention, at least a part of the dehumidifier wall is inclined upon which the actuating switch is mounted. The switch is mounted in a vertically adjustable manner. For example, with the inclined wall progressively projecting away from the dehumidifier from top to bottom, the switch can be shifted downward to increase the level of the condensate in the receptacle before shut-off. Upward shifting of the switch achieves the opposite effect.

BRIEF DESCRIPTION OF THE DRAWINGS

FIG. 1 is a perspective view of one form of mounting structure for the receptacle according to the invention including assembled spring clip supports;

FIG. 2 is an enlarged, perspective view of one of the spring clip supports in FIG. 1;

FIG. 3 is a plan view of the mounting structure in FIG. 1;

FIG. 4 is a fragmentary, side elevation view of the mounting between one of the spring clip supports and the receptacle;

FIG. 5 is a fragmentary, sectional view of the switch control on the mounting structure in FIG. 1 with the receptacle in place;

DETAILED DESCRIPTION OF THE DRAWINGS

Figure 6:
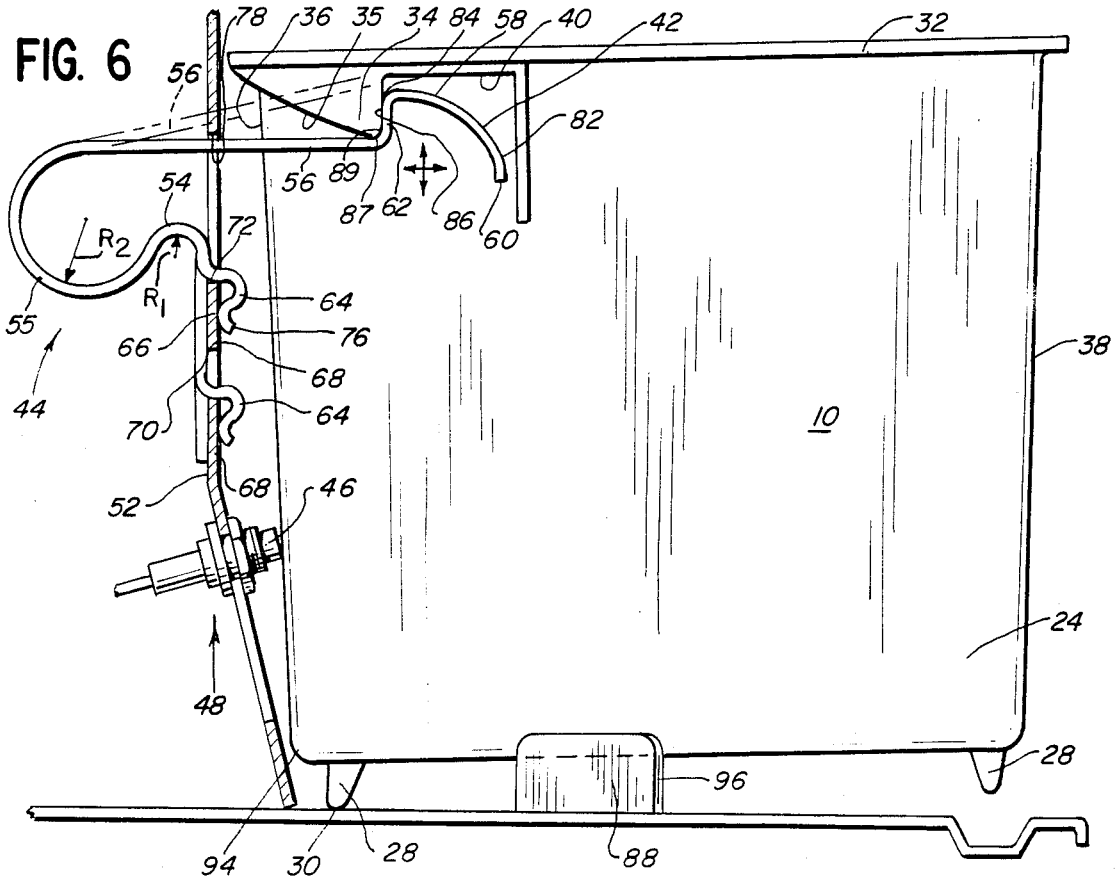
FIG. 6 is a side elevation view of a receptacle incorporating a modified switch mounting arrangement according to the present invention, with the receptacle either empty or the liquid accumulation in the receptacle below a predetermined shut-off level.
Figure 7:
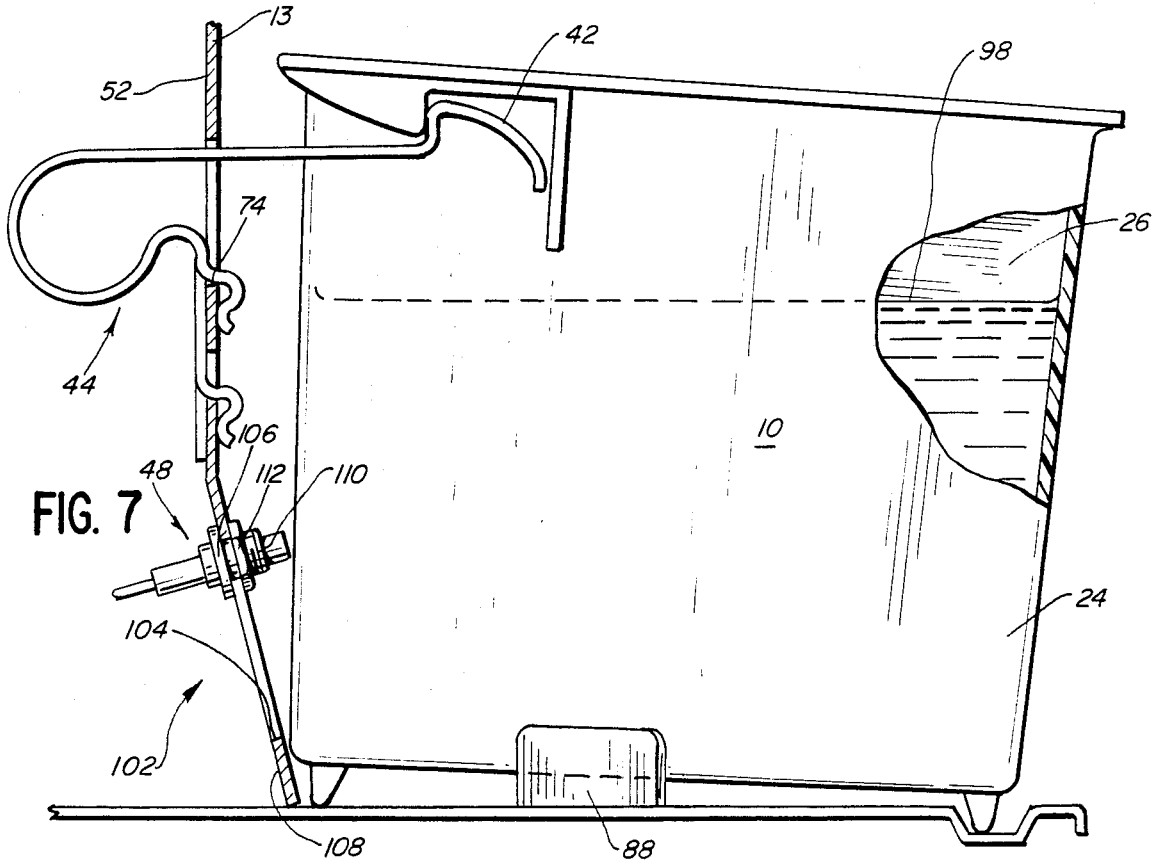
FIG. 7 is a view similar to that in FIG. 6 with liquid accumulated to the predetermined shut-off level.

A first form of mounting structure for a condensate collecting receptacle 10 of the type shown in FIGS. 6 and 7 is depicted in FIGS. 1–5. The level adjustment structure in the embodiment shown in FIGS. 6 and 7 is slightly modified from that in FIGS. 1, 3 and 5. The structure is otherwise the same in all the figures and will be consistently numbered throughout this description.

The basic receptacle support concept embodied in the mounting assembly at 12 is a type conventionally associated with a dehumidifier or other structure that slowly accumulates condensate. The mounting assembly 12 is formed from sheet metal and comprises an upright wall 13 and integral side walls 14, 16 turned at right angles to the plane of the upright wall 13. A support platform 18 has spaced, upwardly directed edges 20, 22 closely overlying the bottom portion of the sidewalls 14, 16 and secured thereto as by welding.

The basic assembly 12 is integrally formed with the dehumidifier or may be otherwise suitably attached in known manner. With the assembly 12 in place the support platform 18 is oriented substantially horizontally.

The receptacle 10 which coacts with the assembly 12, as seen in FIGS. 6 and 7, comprises with a fluid tight, substantially cubical shell 24 with an open top and defines a reservoir 26 for accumulating the condensate. A support leg 28 is formed at each corner of the receptacle. Each leg has a bottom guide surface 30 which is slidable along the flat surface of the support platform 18.

As shown in FIG. 4, the receptacle 10 is positioned to receive condensate from an evaporator 31, which is disposed within the dehumidifier above the receptacle and may be of conventional construction.

At each side of the receptacle 10 and adjacent the upper rim 32 is a guide boss 34 having a ramp surface 35 which is inclined downwardly between the leading face 36 of the receptacle and the trailing face 38.

Behind each guide boss 34 is a downwardly opening, squared, female socket 40 which accommodates a cammed portion 42 of a spring clip support at 44, mounted on the wall 13 of the dehumidifier.

The empty receptacle 10 is supported in a tilted position as seen in FIG. 6 with the legs 28 adjacent the leading face 36 against the platform and the cammed surface portion 42 in the socket 40. Like support is provided on each side of the receptacle. The spring clip supports exert a force at the upper portion of the receptacle which resists pivoting of the upper portion of the receptacle away from the wall 13 in a controlled manner. The supports 44 deform in response to a buildup of condensate in the receptacle and guide pivoting of the receptacle about the bearing support legs 28, causing the face 36 to release an actuating button 46 associated with a shut-off switch 48. The configuration of the spring clip supports 44, which support and exert the desired force on the receptacle, is described in the following paragraphs.

Each spring clip support 44 is formed from a single strip of thin spring metal material. A mounting portion 50 facially abuts the back surface 52 of the wall 13. From the mounting portion 50 the strip material is bent through an arc 54 of approximately 180° with a radius designated R1 in FIG. 6. From the first arc portion 54 the strip is reverse curved through an arc 55 with a radius R2 and terminates in a straight support arm 56 defining a cam surface 58 adjacent its free end 60. The support arm 56 has a perpendicular offset 62 which leads into the cam surface which curves continuously and doubles back beyond the line of the straight portion of the support arm 56.

The spring clip support 44 is affixed to the wall 13 by providing a pair of retaining tabs 64, which are struck directly from the mounting portion 50. Each tab 64 is substantially S-shaped with the apex 66 of one of the curves bearing against the flat surface 68 of wall 13.

The lower tab 64 is accepted in a round aperture 70 in the wall 13. The upper tab surrounds an edge 72 of a rectangular opening 74 in the wall 13 which admits the protruding support arm 56 of a spring clip support. The free ends 76 of the tabs are offset away from the plane of the mounting portion to facilitate admission into the opening 74 and aperture 70. With the tabs in place, the wall 13 is closely captured between the tabs and the mounting portion 50.

The spring clip support 44 is mounted by initially extending the support arm 56 through the aperture 74. The arm 56 does not make a right angle with the mounting portion with the spring clip support relaxed. As indicated in dotted lines in FIG. 6, the arm 56 is skewed at approximately 10° from a perpendicular orientation and the support arm 56 must be preloaded or, in other words, collapsed toward the first arc portion 54 sufficiently to permit simultaneous placement of the tabs 64 in their seats and passage of the arm 56 through the aperture 74. With the spring mounted, the upper edge 78 defining the aperture 74 abuts the arm 56 and consistently maintains a horizontal orientation of the arm and residual forces in the arm.

With the spring mounted as shown in FIG. 6, the arm 56 has substantial flexibility vertically but provides controlled resistance to horizontal deformation. This is a result of the dual radius construction. The larger spring radius R2 is primarily determinative of the freedom with which the free end of the spring moves horizontally, while the small radius R1 portion allows the larger diameter portion of the spring to rotate as the free end of the spring is moved vertically. An exemplary value for the radii would be a ½ inch value for R2 and a 3/16 inch value for R1.

Upon advancing the receptacle toward the dehumidifier, the ramp surface 35 of the guide boss 34 encounters the nose 82 of the clip support 44 as shown in dotted lines in FIG. 4. The ramp surface 35 and cam surface 58 cooperate to deflect the arm 56 downwardly until the offset 62 clears the guide boss 34. At this point the cam surface is propelled into the socket 40 by the residual force in the clip support developed through preloading and through the additional deflection from the encounter with the ramp surface 35.

The trailing surface 84 of the guide boss 34 facially abuts the adjacent surface 86 on the offset 62. A force tending to pivot the receptacle 10 upon the accumulation of condensate is transmitted to the spring clip primarily through the face 86 and a curved edge 87 in the boss which fits in the corner 89 at the intersection of the arm 56 and the offset 62.

An important advantage with this connection is the feel that it gives the user when the cam surface springs back into the socket. Due to the substantial residual forces in the arm 56, the arm 56 rebounds with sufficient impact to click into place and reverberate through the receptacle to alert the user that the engagement is complete.

To assure that the cam surface 58 aligns properly with the socket 40, a pair of spaced guide tabs 88 are provided on the platform 18. Each tab comprises an upstanding length of metal which is lanced or struck from the support platform 18.

As the receptacle 10 is introduced, the rounded corners 94 of the receptacle are intercepted by the guide tabs 88 which are skewed in converging manner toward the upright wall 13. The rounded nature of the corners 94 prevents hangup at the leading edge 96 of the guide tabs. The supporting legs 28 are disposed sufficiently toward the center of the receptacle so as not to interfere with the apertures 92 associated with the struck tabs 88 upon introduction of the receptacle.

The empty receptacle mounted in FIG. 6 is situated to depress the actuating button 46 on the switch 48. The receptacle 10 is inclined so that the trailing legs 28 are elevated above the platform. Upon accumulating condensate, the receptacle pivots about the bearing legs 28 in a clockwise fashion in the figures. At a predetermined condensate level 98 this pivoting moves the leading face 36 of the receptacle away from the actuating button 46 sufficiently, as shown in FIG. 7, so as to interrupt operation of the dehumidifier. To afford a suitable pivoting range, a pair of depressions 100 are provided in the platform to accept the trailing support legs 28.

One arrangement to adjustably set the shut-off level is shown in FIGS. 6 and 7. In these figures the lower portion of wall 13 is inclined from the vertical adjacent the support platform 18 and makes an angle with respect to the adjacent receptacle face 36. The inclined portion has a vertically extending slot 104 within which the shut-off switch is positioned. The shut-off switch mount consists of a hub 106 bearing on the back surface 108 of the inclined wall portion and a threaded portion 110 protruding through the slot for accepting a locking nut 112. By tightening the locking nut on the threaded portion, the inclined portion 102 is securely captured between the hub 106 and nut 112 so that the shut-off switch can be secured as desired at any vertical location within the range of the slot.

With the adjusting capability incorporated, movement of the shut-off switch downwardly in FIG. 7 increases the required pivoting to disengage the actuator button and therefore requires additional weight in the receptacle. This additional weight can be gauged in terms of the fluid accumulation in the reservoir to choose a desired shut-off level.

In this embodiment, the lower, inclined portion of the wall 13 serves as a stop which abuts the corners 94 of the receptacle to properly position the bearing legs 28 as the receptacle is installed.

A modification of the device to exclude the inclined portion 102 is shown in FIGS. 1, 2 and 5. In the modified embodiment the wall 13 is flat throughout. The shut-off switch 48 is mounted to the wall in a fixed position.

Beneath the level of the switch a pair of adjusting tabs 114 struck out of the plane of the wall 13. The tabs are bent in an L-shape defining a corner 116 for abutment with the leading surface 36 of the receptacle 10. The tabs are normally bent out of the plane of the wall 13 an amount determined by the desired shut-off level. The tabs may be factory set.

The corner 116 serves as a spacer between the leading face 36 of the receptacle and the wall 13; the further the extension of the corner from the wall, the less the pivoting of the receptacle required to disengage the button 46 to shut off the dehumidifier. The operation of the device in FIGS. 1, 2 and 5 is in all other respects the same as previously described.

It should be understood that the foregoing description was made for purposes of clarifying the structure and operation of the invention with no unnecessary limitations to be derived therefrom.

Having described the invention, the embodiments of the invention in which an exclusive property or privilege is claimed are defined as follows:

1. An improved support for a condensate accumulating receptacle associated with an apparatus that discharges a liquid during operation and has a shut-off switch to interrupt its operation, said receptacle having a top portion and an opening for admitting condensate from the apparatus, said support comprising:

pivot means associated with the receptacle for guiding pivoting movement of said receptacle relative to said apparatus; and spring clip means on said apparatus engaging said receptacle top portion to at least partially support said receptacle and simultaneously provide controlled resistance to said pivoting movement, said receptacle pivoting in response to a buildup of condensate in said receptacle and upon pivoting a predetermined amount with said condensate at a desired level causing said shut-off switch to interrupt operation of said apparatus.

2. An improved support for a condensate accumulating receptacle associated with an apparatus that discharges a liquid during operation and has a shut-off switch to interrupt its operation, said receptacle having a top portion and an opening for admitting condensate from the apparatus, the improvement comprising:

pivot means associated with the receptacle for guiding pivoting movement of said receptacle relative to said apparatus;

spring clip means extending between said apparatus and said receptacle top portion, at least partially supporting said receptacle and providing controlled resistance to said pivoting movement, said receptacle pivoting in response to a buildup of condensate in said receptacle and upon pivoting a predetermined amount with said condensate at a desired level causing said shut-off switch to interrupt operation of said apparatus, said receptacle having a flat wall facing a flat wall portion on the apparatus with the receptacle in assembled relationship with the apparatus, said flat wall of the receptacle and the flat wall portion on the apparatus being angularly disposed relative to each other in a vertical direction; and means mount the shut-off switch adjustably in a vertical direction on the flat wall portion of the apparatus whereby adjustment of the vertical location of the shut-off switch permits variation of the level to which the condensate rises before the shut-off switch interrupts operation of the apparatus.

3. An improved support for a condensate accumulating receptacle associated with an apparatus that discharges a liquid during operation and has a shut-off switch to interrupt its operation, said receptacle having a top portioh and an opening for admitting condensate from the apparatus, the improvement comprising:

pivot means associated with the receptacle for guiding pivoting movement of said receptacle relative to said apparatus; and spring clip means extending between said apparatus and said receptacle top portion, at least partially supporting said receptacle and providing controlled resistance to said pivoting movement, said receptacle pivoting in response to a buildup of condensate in said receptacle and upon pivoting a predetermined amount with said condensate at a desired level causing said shut-off switch to interrupt operation of said apparatus, said shut-off switch having a depressible button normally biased to an undepressed state, said apparatus being operable with the button in a depressed state, said receptacle engaging and depressing the button so as to cause operation of the apparatus with the receptacle in an assembled position and the condensate in the receptacle below said desired level, said receptacle pivoting to permit the button to assume its undepressed state with the condensate accumulated to the desired level to interrupt operation of the apparatus so that inadvertent operation of the apparatus without the receptacle in place is prevented.

4. An improved support for a condensate accumulating receptacle associated with an apparatus that discharges a liquid during operation and has a shut-off switch to interrupt its operation, said receptacle having an upper portion and a bottom portion, said support comprising:

a platform extending transversely from an upright wall on said apparatus and having a flat portion for supporting said bottom portion of said receptacle to allow pivoting movement of the upper portion of the receptacle away from said upright wall;

spring clip means on said upright wall; and mounting means associated with said upper portion of said receptacle for snap-fitting with said spring clip means;

said spring clip means providing controlled resistance to said pivoting movement, whereby said receptacle pivots in response to a buildup of condensate in said receptacle and upon pivoting a predetermined amount with said condensate at a desired level causes said shut-off switch to interrupt operation of said apparatus.

5. The improved support for a condensate accumulating receptacle according to claim 4 wherein said receptacle has a first pair of support legs on the receptacle bottom for supporting the receptacle on the flat portion of the platform and a second pair of support legs elevated above the platform with said receptacle empty and mounted to the apparatus and said platform has downwardly extending recesses to accept the second pair of support legs with the receptacle pivoted upon the condensate accumulated to said desired level.

6. The improved support for a condensate accumulating receptacle according to claim 4 wherein said mounting means and spring clip means are engagable upon advancing the upper portion of the receptacle towards the upright wall with said receptacle bottom guided along the flat portion of the platform and guide means are provided on the flat platform to align the mounting means with the spring clip means as the receptacle bottom is guided along the flat portion of the platform 7. The improved support for a condensate accumulating receptacle according to claim 4 wherein said mounting means and spring clip means are engagable upon advancing the upper portion of the receptacle towards the upright wall with said receptacle bottom guided along the flat portion of the platform, said receptacle has a first pair of support legs on the receptacle bottom for pivotally supporting the receptacle on the flat portion of the platform and a second pair of support legs elevated above the platform with said receptacle empty and mounted to the apparatus and said platform has downwardly extending recesses to accept the second pair of support legs with the receptacle pivoted upon the condensate accumulating to said desired level, and guide means comprising a pair of spaced tabs extending upwardly from the flat portion of the platform and cooperatively diverging away from the wall of the apparatus.

8. The improved support for a condensate accumulating receptacle according to claim 4 wherein said receptacle has a wall facing the upright wall of the apparatus and at least one tab protrudes from the upright apparatus wall toward the receptacle wall with the receptacle in assembled relationship with the apparatus, said tab abutting the facing receptacle wall, spacing the receptacle wall from the upright apparatus wall and guiding pivoting of the receptacle as the condensate level builds in the receptacle.

9. The improved support for a condensate accumulating receptacle according to claim 4 wherein said mounting means and spring clip means are engagable upon advancing the upper portion of the receptacle towards the upright wall with said receptacle bottom guided along the flat portion of the platform and said receptacle has a first pair of support legs on the receptacle bottom for supporting the receptacle on the flat portion of the platform and a second pair of support legs elevated above the platform with said receptacle empty and mounted to the apparatus, said platform having downwardly opening recesses to accept the second pair of guide legs when the condensate has accumulated to said desired level in the receptacle, and guide means comprising a pair of spaced tabs extending upwardly from the flat portion of the platform and diverging away from the wall of the apparatus, and an adjusting tab being struck directly from the upright apparatus wall and projecting away from the wall at an angle, whereby said desired level can be adjusted by varying the angle of projection of the tab.

10. An improved support for a condensate accumulating receptacle associated with an apparatus that discharges liquid condensate during operation, said apparatus having an upright all and a shut-off switch carried by said wall for interrupting operation of said apparatus, comprising:

support means for supporting said receptacle for pivotal movement adjacent said wall, said receptacle being arranged to engage said shut-off switch when said receptacle is empty; and spring clip means extending between said apparatus and said receptacle above said support means for retaining said receptacle in said apparatus and providing controlled resistance to pivotal movement of said receptacle, whereby said receptacle pivots away from said apparatus wall sufficiently to cause said shut-off switch to interrupt the operation of said apparatus upon the accumulation of a predetermined amount of condensate in said receptacle.

11. The improved condensate accumulating receptacle support according to claim 10, wherein said spring clip means comprises a one-piece element having: a mounting portion for attaching the spring clip to said apparatus wall; a first arcuate portion extending from the mounting portion and having a first radius; a second arcuate portion extending from said first arcuate portion and curved oppositely to said first arcuate portion and having a second radius greater than said first radius; a deflectable arm portion extending from said second arcuate portion; and means associated with said deflectable arm portion for attachment to a portion of said receptacle, said spring clip being fabricated from a deformable, resilient material capable of being mounted on the apparatus so that at least a portion of the arm including said means extends out of the plane of the upright wall of the apparatus and is freely deflectable in a first direction but resists deflection transverse to said first direction.

12. The improved condensate accumulating receptacle according to claim 11 wherein said upright wall on the apparatus has oppositely facing surfaces on opposite sides of the wall and first and second apertures, said clip mounting portion having a tab extending through the first aperture for anchoring the mounting portion on one surface of the wall, said first and second arcuate portions residing on the one side of the wall and said arm portion extending through said second aperture and having at least a portion on the side opposite the one side for engagement with the receptacle with said spring clip in assembled relationship with the apparatus.

13. The improved condensate receptacle support according to claim 11 wherein said apparatus wall has a first aperture, at least one tab is struck from the clip mounting portion and extends through the first aperture and cooperates with the apparatus wall to fix the mounting portion against the wall of the apparatus, and said arm portion is preloaded and biased toward the mounting portion with the spring clip mounted on the apparatus.

14. The improved condensate receptacle support according to claim 11 wherein said receptacle has a socket and said means associated with said deflectable arm portion comprises a cam portion for biasably engaging the socket with the receptacle assembled in the apparatus.

15. The improved condensate receptacle support according to claim 11 wherein the wall of the apparatus has an aperture, at least one tab is struck from said clip mounting portion and extends through the aperture and cooperates with the apparatus wall to fix the mounting portion against the wall of the apparatus, said clip arm portion is biased toward the mounting portion with the spring clip mounted on the apparatus, and said apparatus has a generally horizontal platform bearing against a bottom portion of the receptacle which in conjunction with said spring clip supports the receptacle.

16. An improved support for a condensate accumulating receptacle associated with an apparatus that discharges liquid condensate during operation, said apparatus having an upright wall and a shut-off switch carried by said wall for interrupting operation of said apparatus, comprising:

a generally horizontal support platform extending transversely of said upright wall to define a support surface on which a lower portion of said receptacle is pivotally supported;

first and second spaced spring clip means mounted on said upright wall each of said clips having a free end extending generally outwardly with respect to said wall;

first and second spaced ramp surfaces on said receptacle adjacent a top portion of said receptacle for cooperation with said first and second clip means, respectively; and, first and second sockets on said receptacle adjacent said first and second ramp surfaces, respectively, whereby the free ends of said clips are deflected by said ramp surfaces and seat in said sockets as said receptacle is moved to a condensate receiving position adjacent said wall, releasably coupling said clips to said receptacle to provide controlled resistance to pivotal movement of said receptacle away from said wall.

* * * * *